US005211614A

United States Patent [19]

Henes

[11] Patent Number: 5,211,614

[45] Date of Patent: May 18, 1993

[54] EXERCISE MACHINE

[76] Inventor: Richard W. Henes, 5816 E. Mockingbird La., Paradise Valley, Ariz. 85253

[21] Appl. No.: 824,825

[22] Filed: Jan. 23, 1992

[51] Int. Cl.[5] ..... A63B 21/06

[52] U.S. Cl. ..... 482/102; 482/133; 482/138

[58] Field of Search ..... 482/92, 93, 94, 97-103, 482/133, 135-138

[56] References Cited

U.S. PATENT DOCUMENTS

| | | | |
|---|---|---|---|
| 3,640,527 | 2/1972 | Proctor . | |
| 3,708,166 | 1/1973 | Annas . | |
| 3,912,261 | 10/1975 | Lambert, Sr. . | |
| 4,149,713 | 4/1979 | McLeod . | |
| 4,296,924 | 10/1981 | Anzaldua et al. . | |
| 4,349,194 | 9/1982 | Lambert, Jr. et al. . | |
| 4,361,323 | 11/1982 | Segersten | 482/102 |
| 4,465,274 | 8/1984 | Davenport | 482/138 X |
| 4,482,152 | 11/1984 | Wolff . | |
| 4,505,475 | 3/1985 | Olschansky et al. . | |
| 4,541,628 | 9/1985 | Parviainen . | |
| 4,603,855 | 8/1986 | Sebelle . | |
| 4,634,127 | 1/1987 | Rockwell | 482/138 |
| 4,635,933 | 1/1987 | Schnell . | |
| 4,721,301 | 1/1988 | Drake | 482/102 |
| 4,721,303 | 1/1988 | Fitzpatrick | 482/103 |
| 4,744,560 | 5/1988 | Azari | 482/102 X |
| 4,757,992 | 7/1988 | Heitsch et al. . | |
| 4,809,972 | 3/1989 | Rasmussen et al. . | |
| 4,826,157 | 5/1989 | Fitzpatrick . | |
| 4,844,456 | 7/1989 | Habing et al. . | |
| 4,900,018 | 2/1990 | Ish, III et al. . | |
| 4,949,951 | 8/1990 | Deola | 482/138 |
| 4,953,855 | 9/1990 | Shields . | |
| 4,974,837 | 12/1990 | Someya et al. . | |

FOREIGN PATENT DOCUMENTS

| | | | |
|---|---|---|---|
| 7609655 | 3/1978 | Netherlands | 482/102 |
| 8005681 | 5/1982 | Netherlands | 482/138 |

*Primary Examiner*—Robert Bahr
*Attorney, Agent, or Firm*—Warren F. B. Lindsley

[57] ABSTRACT

This invention is directed to an exercising apparatus on which multiple exercising routines may be performed from a single station area operating in opposition to a single set of weights and wherein three cable systems are operable independent from each other with pulley systems being positioned at high level, low level and mid level of the frame of the apparatus.

6 Claims, 3 Drawing Sheets

10
2
3
16A
38
23
21
19
22
39
20
41'
17
47
44
4
41
32
43'
30
18A
46
38
45'
26
48
38
45
43
12
46
14
44
18A
47
16
11
15C
13
15B
15B
51
15D
52
24
27
50
15A
15
25
53
2
3
26
17A
54
48
47

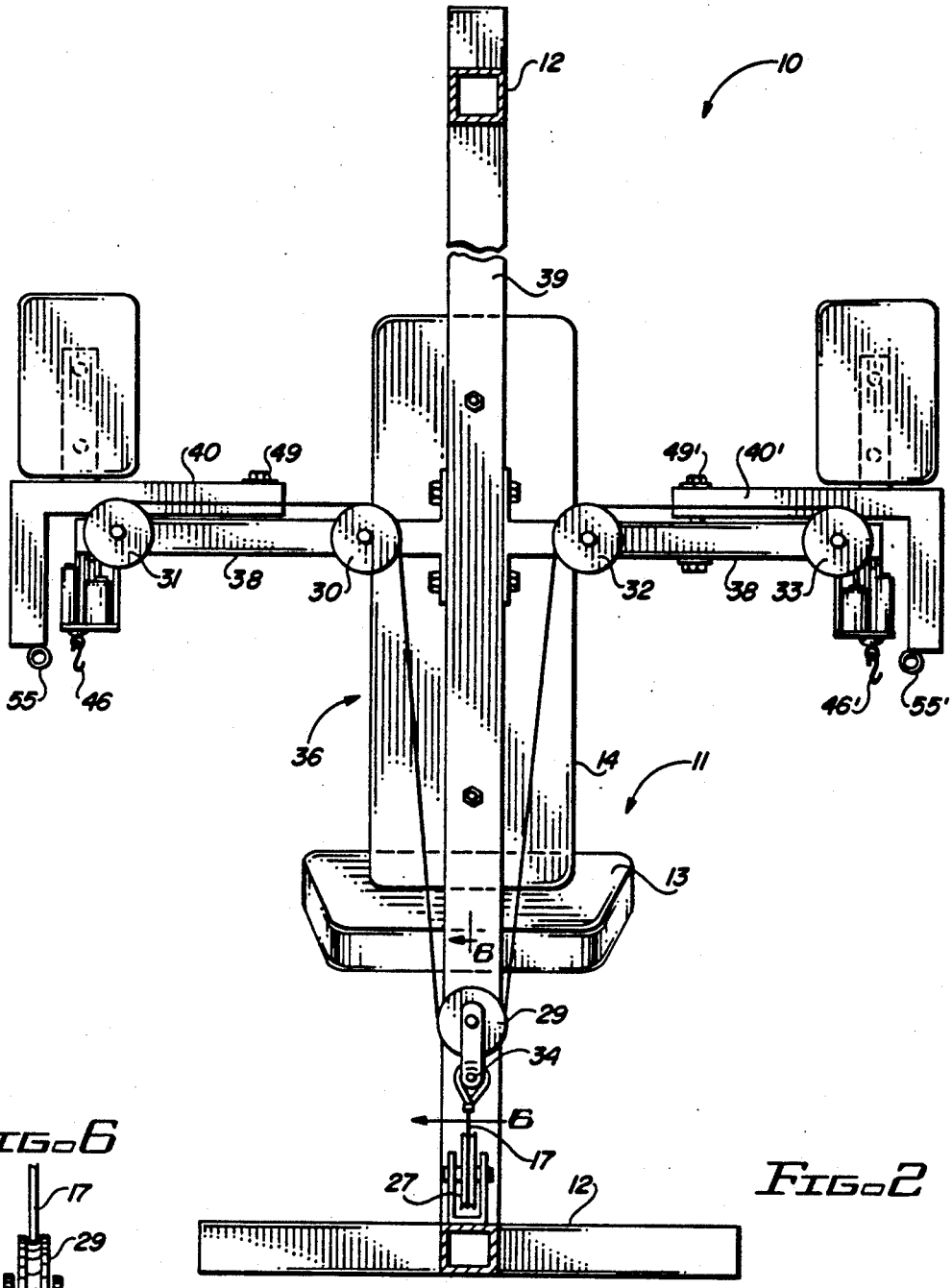
FIG. 2
FIG. 6
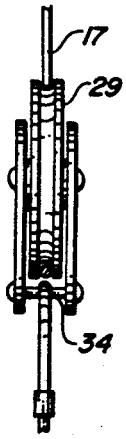
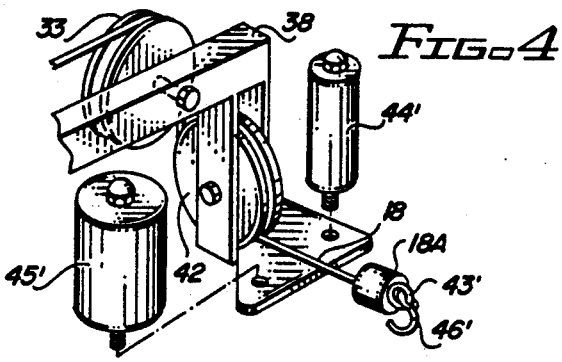
FIG. 4
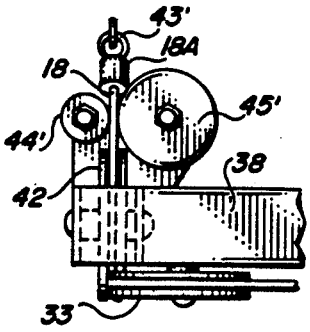
FIG. 5

EXERCISE MACHINE

BACKGROUND OF THE INVENTION

This invention relates to exercise machines of the type having multiple exercise units which operate in opposition to a single source of reactance to movement such as a stack of free weights. More particularly, the machine is adapted for use in the home or gym where space is at a premium and multiple exercise functions can be performed from a single station area at one side of the machine.

Exercise of the human body is accomplished against reactance to movement imposed on ropes or cables utilizing the force of gravity, spring pressure, an air cylinder, a rubber band, electro magnetism, dynamic friction, or the like, which ropes or cables issue from the apparatus at various heights depending on the nature of the specific exercise and the build of the person using the apparatus.

The present invention provides a simplified arrangement in which multiple exercise units are continuously connected to a source of reactance to movement such as a single weight set by a pulley and cable system employing mid-level pulleys which are attached to the weight set by a single centered cable.

DESCRIPTION OF THE PRIOR ART

Various types of exercising equipment departing from the form of the conventional weight lifting sets are described in the prior art.

The following patents appear to be of general interest but are not believed to anticipate the claimed invention.

| | |
|---|---|
| 4,953,855 | 4,349,194 |
| 4,505,475 | 4,482,152 |
| 4,844,456 | 3,708,166 |
| 4,809,972 | 4,826,157 |
| 4,900,018 | 4,635,933 |
| 4,541,628 | 3,640,527 |
| 3,912,261 | 4,149,713 |
| 4,603,855 | 4,296,924 |
| 4,757,992 | 4,974,837 |

U.S. Pat. No. 4,953,855 discloses a split phase cam-controlled weight lifting exercise machine employing two independent selectable weight stacks connected by cable and pulley assemblies.

U.S. Pat. No. 4,505,475 discloses an exercise system providing reversible displacement of at least one weight element.

U.S. Pat. Nos. 4,844,456; 4,809,972 and 4,900,018 disclose multi station areas.

U.S. Pat. No. 4,541,628 disclose a means of connecting the forces of an athlete's body over an eccentric rotatable element.

U.S. Pat. No. 3,912,261 discloses a cable system which extends from eccentric pulleys rotated by the exercise action of the user to an adjustable weight unit. The eccentric pulley varies the weight load during each exercise cycle to provide uniform exercise for the muscles.

U.S. Pat. No. 4,603,855 discloses an exercise apparatus having cables pullable against varying resistance along one or more horizontal arms adjustable as to height, length and as to the angle of the arms to each other and to the frame of the apparatus.

U.S. Pat. Nos. 4,757,992; 4,349,194; 4,482,152; 3,708,166 and 4,826,157 disclose single seat exercise apparatus for providing various exercises.

U.S. Pat. No. 4,974,837 discloses an exercise apparatus employing a shock damper that damps shock and vibrations generated by the impact of lifted weight blocks.

U.S. Pat. No. 4,296,924 discloses a rectangular frame wherein the exerciser remains in an upright position while exercising.

U.S. Pat. No. 4,635,933 discloses an exercising device employing a transmission having selected transmission ratios to which an arm of the exercising device is attached.

U.S. Pat. No. 3,640,527 discloses an exercising machine wherein the machine employs a padded table upon which the person using the exercise machine may lie in a faceup position.

U.S. Pat. No. 4,149,713 discloses a weight lifting device for the lower extremities employing a table having a horizontally translatable chair mounted thereon.

None of the patents disclose the claimed exercising machine utilizing, inter alia, a pair of outboard mid-level pulleys one to the left and one to the right of the user, at approximately shoulder height for the user, and slightly to the rear of the user when seated. Each of the pulleys carry a cable which is in lifting communication with the weight stack which comprises the source of reactance to movement.

SUMMARY OF THE INVENTION

In accordance with the invention claimed, a new and improved exercising device is disclose which materially reduces the structure for use in performing the popular exercises for most human muscles as well as the mass, complexity and cost of construction.

It is, therefore, one object of this invention to provide a new and improved exercising device.

Another object of this invention is to provide an exercising apparatus in a form that permits simulation or practice of all the conventional exercises commonly practiced with the use of conventional barbell or weight sets.

A further object of this invention is to provide an exercising machine that reduces the space requirements over the prior art structures.

A still further object of this invention is to provide a single operator's station with unrestricted high pulley exercises, unrestricted mid-level (seated and standing) exercises, and unrestricted low pulley exercises.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which:

FIG. 2 is a cross sectional view of FIG. 1 taken along the line 2—2;

FIG. 4 is an enlargement of the circled area 4 of FIG. 1;

FIG. 5 is a top view of FIG. 4;

FIG. 6 is a cross sectional view of FIG. 2 taken along the line 6—6;

DESCRIPTION OF THE PREFERRED EMBODIMENT

Figures 1, 7, 9:
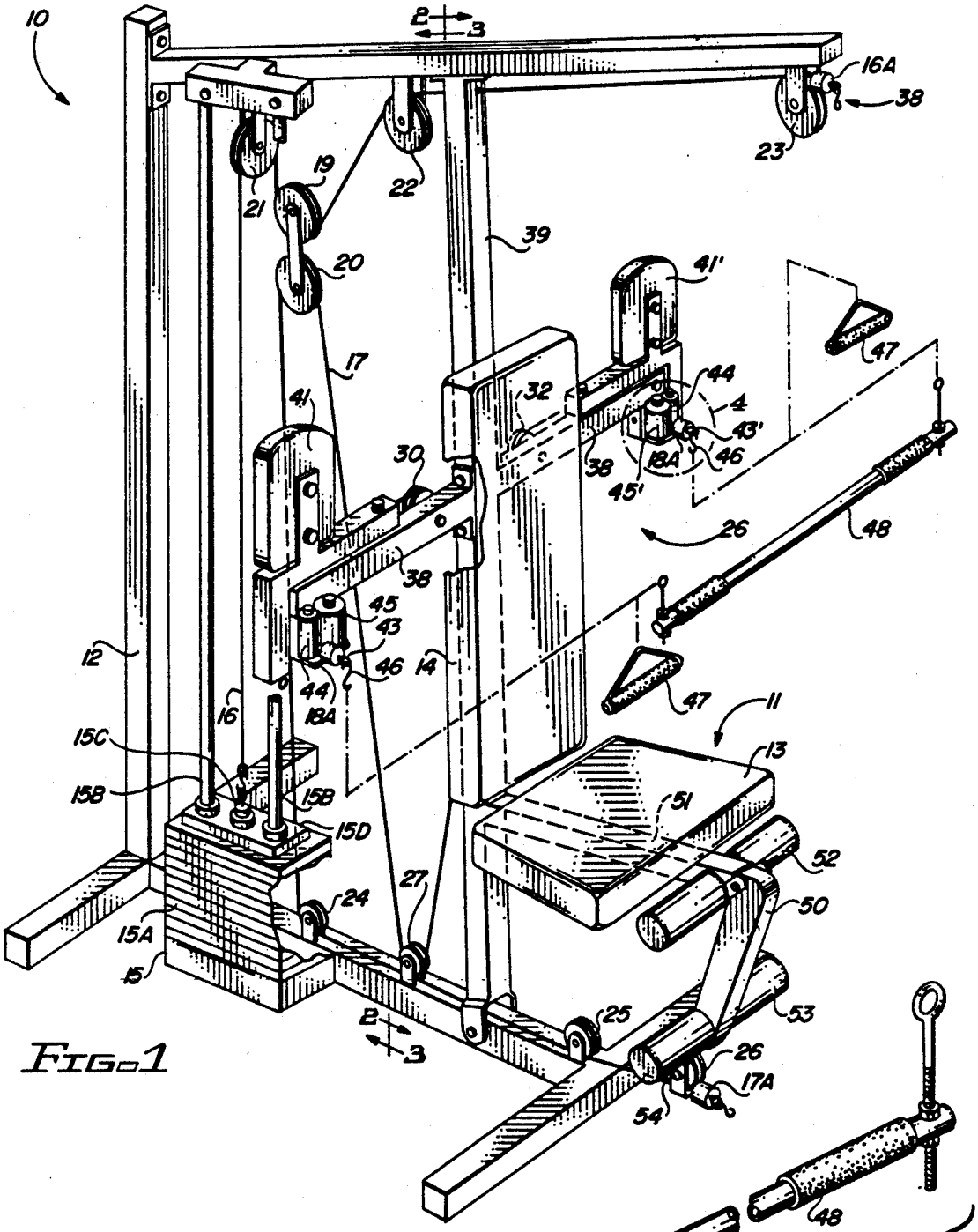
FIG. 1 is a perspective view partially broken away of an exercising device embodying the invention.
FIG. 7 is a perspective view of the hand grip shown in FIG. 1.
FIG. 9 is a perspective view of the bar shown in FIG. 1.
Figure 3:
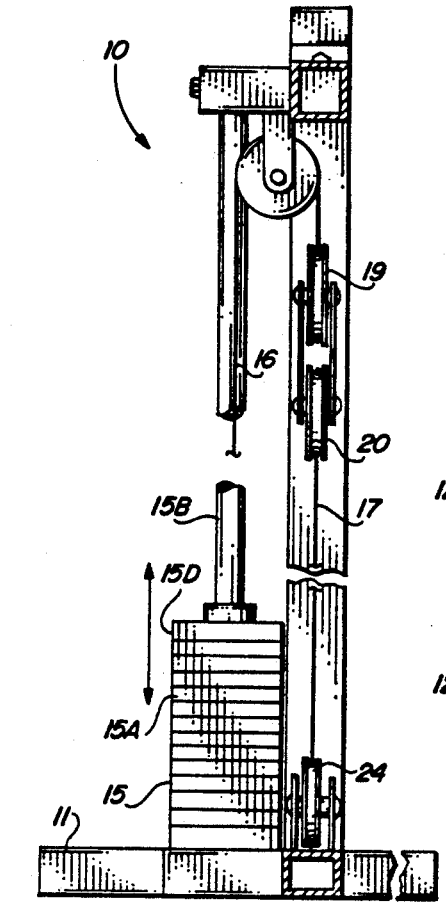
FIG. 3 is a cross sectional view of FIG. 1 taken along the line 3—3.
Figure 8A:
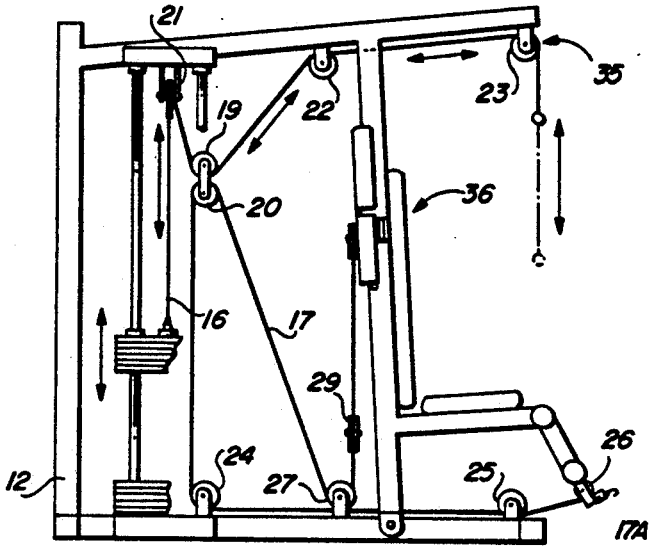
FIGS. 8A–8D illustrate various exercises that can be implemented with the exercising device shown.
Figure 8B:
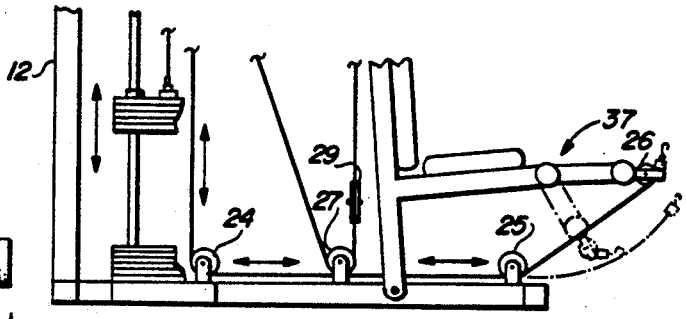
Figure 8D:
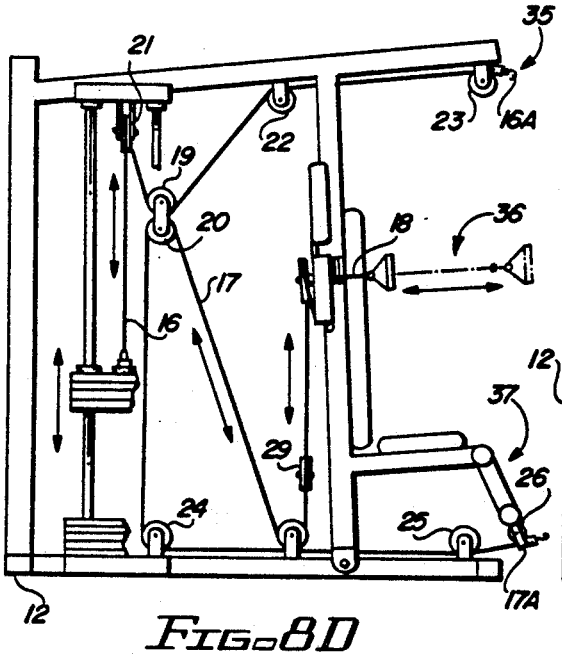
Figure 8C:
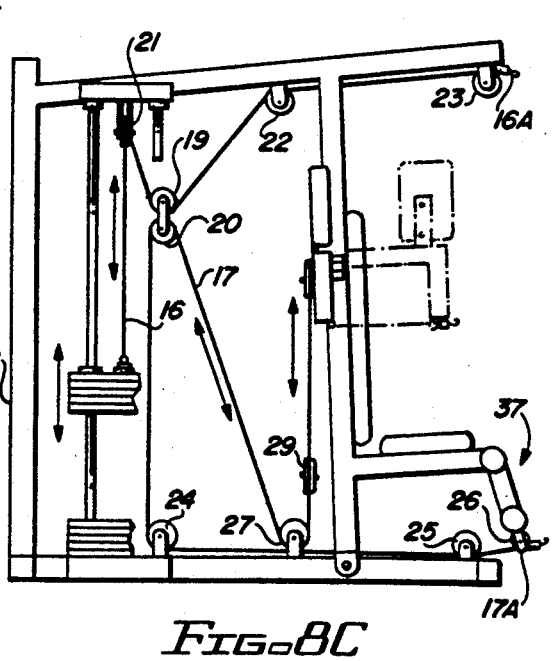

Referring more particularly to the drawings by characters of reference, FIGS. 1–3 disclose an exercising device 10 embodying the invention and comprising an exercising station 11 mounted at one side of a frame 12. The station comprises a seat 13 and back rest 14 from which a user may operatively lift weights in a weight stack unit 15 resting on the base of frame 12. At this one station various exercising routines may be undertaken such as, for example, high pull, shoulder press, butterfly, abdominal crunch, leg curl and low pull activities.

The weight stack unit 15 is of standard construction comprising a stack of rectangular weights 15A which are slide mounted on a pair of vertical guide rods 15B with each weight having a central horizontal hole registering with a respective hole in a central pick-up rod 15C. This pick-up rod depends from a head plate 15D which is also slide mounted on rods 15B and has a lift cable 16 secured thereto. The amount of weight to be lifted is selected by engaging a lock pin (not shown) through the appropriate one of the weights 15A into the pickup rod 15C. Thus, when the cable 16 is adequately tensioned, the selected number of weights in the stack is lifted.

As shown in FIGS. 1 and 8A–8D, cable 16 functions in conjunction with cables 17 and 18 by way of floating pulley set 19–20, the two pulleys in the set being coupled together. Cable 16 is guided by three guide pulleys 21, 22 and 23. Cable 17 is guided by four guide pulleys 24, 25, 26 and 27 and passes beneath the floating pulley 19. Cable 17 passes over the floating pulley 20 and is guided by guide pulleys 24–27. Cable 18 passes over the floating pulley 29 and is guided by guide pulleys 30, 31, 32 and 33 as shown in FIG. 2. Floating pulley 29, as shown in FIG. 6 is connected at point 34 to one end of cable 17.

The high pull unit 35 is connected to one end of cable 16, the mid-level unit 36 is connected at the center of cable 18 to one end of cable 17, the leg curl extension unit 37 is connected to the other end of cable 17. The cables 16, 17 and 18 all have ball or cylinder like stop fittings 16A, 17A and 18A, respectively at their free ends to restrict retraction of the cables.

With the described pulley and cable arrangement it can be seen that the tension in the three cables 16, 17 and 18 is equal whenever one of them is tensioned by operation of an exercise unit. The tension in each half of cable 18 is one half the tension in cables 16 and 17.

Adjacent the mid-level unit 36 and about shoulder height of a user seated on seat 13 with his or her back resting on back rest 14 is provided a pair of axially aligned cross bars 38, 38' which extend laterally of and are attached to upright member 39 of frame 12. To each free end of cross bars 38, 38' is pivotally mounted right angle frame members 40, 40'. One each frame member 40, 40' is mounted one of wings 41, 41' which extend vertically of and above brackets or cross bars 38, 38'.

At the ends of each of cross bar 38, 38' are mounted cable transfer pulleys 42, 42' as shown in FIG. 4, which transfer the direction of movement of ends 43, 43' of cable 18 laterally of arms 38, 38' through a pair of elongated juxtapositioned or parallel rollers 44, 45 and 44', 45' to stops or ball cylinders 18A. This pair of rollers have a lengthwise extent that exceeds the depth of the rollers. Extending from each of stops 18A is a hook 46 for attachment to hand grips 47, press bar 48 or cross bars 38, 38' as illustrated in FIG. 1.

An exerciser, utilizing a single hand grip 47 attached to the hook at the end of cable 16 at the high pulley unit 35, may perform vertical butterfly sweeps, horizontal triceps presses, down slant triceps presses and variations thereof by moving the grip out forwardly of the machine in the plane of the high pulley unit 35. These exercises are performed with one arm at a time while standing.

An exerciser, utilizing a single elongated lat bar connected at its mid point to the hook at the end of cable 16 at the high pulley unit 35 location, may perform front lat pull downs, military pull downs, chinning pull downs, stomach crunches and triceps presses. These exercises are performed with both hands gripping the lat bar simultaneously. The exerciser may perform the exercises either standing, kneeling or seated while facing either toward or away from the machine frame 12.

When an exerciser seated on seat 13, facing forward, desires to perform mid-level pulley exercises, he or she may attach press bar 48 to hooks 46 so that press bar 48 rests against his or her chest. Press bar 48 is then pushed forward horizontally, in a downward slanting direction or in an upwardly slanting direction, or upward vertically, to accomplish shoulder press exercises. Also, in this position, an exerciser may bend forward with press bar 48 against the chest to perform stomach crunch exercises. Using press bar 48, the exerciser may also stand or sit facing back rest 14, and then pull press bar 48 toward himself or herself at varying angles to accomplish row exercises.

An exerciser seated on seat 13, facing forward, may also perform mid-level pulley exercises by attaching hand grips 47 to hooks 46 and then arcuately swinging both hand grips 47 simultaneously forward in sweeping horizontal, down slanting, up slanting or vertical arcs to perform pectoral fly exercises. By swinging the right hand grip 47 singly with the left hand and the left hand grip 47 singly with the right hand, an exerciser can perform a reverse variation of the customary pectoral fly exercise. These exercises all utilize continuously varying compound angle travel of cable 18 over pulleys 42, 42' and rollers 44, 44' and 45, 45', which travel is made possible by the pulley/roller combination shown in FIGS. 4 and 5.

An exerciser may stand on the floor or sit on seat 13 facing back rest 14, gripping one hand grip 47 in each hand, and perform double biceps curls by drawing the hand grips 47 horizontally toward his or her body. Variations of this exercise are possible by drawing the hand grips 47 in down slant or up slant directions toward the body.

An exerciser seated on seat 13, facing forward, may perform guided pectoral fly exercises by connecting catch loops 55, 55' to hooks 46 and then arcuately swinging paddled wings 41, 41' forward to rotate cross bars 38, 38' about pivot screws 49, 49'.

In all of the mid-level pulley exercises, the movement of the press bar 48, grips 47 or paddled wings 41, 41' tensions cable 18 and pulls it over the outer surfaces of rollers 44, 44' and 45, 45' in opposition to the selected number of weights in the weight stack 15. The ends of cable 18 are free to move up and down longitudinally along the outer surfaces of rollers 44, 44' and 45, 45' as exercises are performed.

It should be noted that seat 13 may be used by the exerciser for the mid-level pulley exercises, the high pulley exercises and the low pulley exercises without the movable components of any unit being in the way of the exerciser when not in use.

The seat assembly at station 11 is used to perform the leg extension and leg curl exercises with the base of frame 12 supporting pulleys 24 and 25 with pulley 26 being supported by a leg member 50. Leg member 50 is pivotally supported on a seat support arm 51 which extends laterally outwardly of vertical upright member 39 of frame 12. At the pivotal connection of leg member 50 to seat support arm 51 is mounted a cylindrical padded knee support member 52. At the free end of leg member 50 is mounted a padded cylindrical ankle support 53 with pulley 26 being rotatably mounted on a pulley bracket 54 on the end of leg member 50 with cable 17 terminating in the stop ball or cylindrical stop 17A captured between pulley 26 and its mounting on leg member 50.

To perform the leg extension exercises, the user sits on seat 13 with his or her knees extending over padded supports 52 and behind and under padded ankle supports 53. The legs then may be free to swing forward away from the end of the support arm 51. The user may conveniently grasp hand grips 47 or rod 48 if they are connected to hooks 46. Using both legs, the exerciser pivots his legs at the knee away from the seat, engaging padded support arms 52 and 53 and forcing leg member 50 to swing forward in opposition to the selected load at weight stack 15.

To perform leg curl exercises, the user stands forward of the machine frame 12 facing the seat back 14 and inserts one leg between the rearward surface of a padded ankle support 53 and the forward surface of a corresponding padded support 52. The heel area of the user presses against the ankle support 53 and the knee area of the user's shin presses against the padded support 52. As the user bends his or her knee, the leg member 50 is forced to swing forward of the machine frame 12, rearward in relation to the user, in opposition to the selected load at weight stack 15. The exercise is performed one leg at a time.

The exerciser performs low pulley exercises using an ankle strap, a grip 47, or an elongated bar with a midpoint connecting catch.

Inside kick, outside kick and rear kick thigh exercises are performed with an ankle strap connected to the ankle of one leg of the exerciser at a time and to the hook at the end of cable 17 at the outboard side of low pulley 26. As the kicks are performed with each leg cable 17 is pulled forward of machine frame 12 in opposition to the selected load at weight stack 15.

Upright and seated rows, single and double biceps curls, side bends and shoulder shrugs are performed at the low pulley 26 using either one arm at a time with a grip 47 attached to the hook at the outboard end of cable 17 or using both arms simultaneously with an elongated bar having a midpoint catch attached to the hook at the outboard end of cable 17.

As described herein, the invention claimed is directed to a single stage of performance for a number of exercises which employ unrestricted high level pulley exercises, unrestricted mid-level (seated or standing) exercises and unrestricted low level pulley exercises.

The mid-level pulleys, one to the left and one to the right of the user, at approximately shoulder height, and slightly to the rear of the user when seated, makes it possible to perform a number of exercises at a single station.

Conventional multiple function exercise machines normally provide a high pulley station, a low pulley station and two separate mid-level work stations. The invention claimed herein provides all of these functions at one station thereby dramatically reducing space requirements of the new exercise machine, greatly reducing the material mass and costs of the new exercise machine and greatly increasing the machine's versatility.

For example, at the single station of the exercise machine disclosed, the high level pulley exercises such as front lateral pulldowns; rear lateral pulldowns; chinning pulldowns; triceps pressdowns; triceps extensions; rear triceps extensions; abdominal crunches; vertical butterfly sweeps; and variations thereof may be performed.

At the single station mid-level exercises such as pectoral flies; pectoral sweeps; high, mid-level and low bench presses; incline presses; shoulder presses; full vertical presses; military presses; standing rows; single and double bicep curls; tricep extensions and variations thereof may be performed.

At the low-level position of the cable arrangement exercises such as leg extensions; leg curls; low and upright rows; bicep curls; bent knee sit ups; inside, outside and rear leg raises; side lateral arm raises; tricep kick backs and all variations thereof may be performed.

All of this is accomplished by a single station exercise machine employing a single source of reactance to movement such as a set of weights, and a plurality of unrestricted cable arrangements with a mid-level pulley system. Each cable operates in a generally vertical plane with the second and third cable arrangements operating in vertical planes extending laterally of each other.

An effective exercise machine is thus provided in accordance with the stated objects of the invention and although but one embodiment of the invention has been illustrated and described, it will be apparent to those skilled in the art that various changes and modifications may be made therein without departing from the spirit of the invention or from the scope of the appended claims.

What is claimed is:

1. An exercise machine comprising:

an exercise station, a source of reactance to movement of a cable means, an accessory connection means, cable means connected at one end to said source of reactance and at its other end to said accessory connection means, pulley means, a pair of elongated juxtapositioned parallelly arranged rollers for receiving therebetween a portion of said other end of said cable means and providing for continuously varying compound angle travel of said cable means during exercises, said rollers have a lengthwise extent that exceeds the depth of the rollers, said cable means at its other end passing over said pulley means which laterally redirects said other end of said cable means to pass between said rollers, whereby said redirected portion of said cable means is randomly removable along the surface of said rollers for providing variable angular travel of said other end of said cable means.

2. The exercise machine set forth in claim 1 wherein:

said accessory connection means comprises a link.

3. The exercise machine set forth in claim 1 wherein:

said source of reactance to movement comprises a movable weight mounted on said machine for vertical displacement.

4. An exercise apparatus comprising:

a rigid frame, a source of reactance to movement mounted on said frame, an exercise station for performing a plurality of exercising procedures therefrom, a multi function exercise unit operable from said station, said multi function exercise unit comprising a pair of independent, laterally separated pulleys mid-level of said frame, each of said pulleys provided with a cooperating pair of parallel elongated juxtapositioned rollers, one roller mounted along each outboard side of each pulley on an axis normal to the axis of said pulley, said rollers of each pair spaced apart a distance not greater than twice the width of said pulley, said rollers having a lengthwise extent that exceeds the depth of the rollers, a cable and pulley system connected to each of said pulleys when the pulleys are idle and in use, the first of said cables connected to said source of reactance against movement at one end thereof and at the other end to a second cable midway between its ends, said second cable being connected at each end thereof through mid-level pulley arrangements to one of said mid-level pulleys and between its cooperating pair of parallel elongated rollers for providing continuously varying compound angle travel of said second cable during exercise.

5. An exercise apparatus comprising:

a rigid frame, a source of reactance to movement mounted on said frame, a single exercise station for performing a plurality of exercising procedures therefrom, at least two exercise units operable from said station, a cable and pulley system connected to each of said exercise units when the exercise units are idle and in use, said cable and pulley system comprising a plurality of separate cables and associated pulleys, the first of said cables being connected to said source of reactance to movement at one end thereof and at the other end to a first exercise unit mounted on said frame, two floating pulleys coupled together, said first cable passing over one of said floating pulleys, a second cable passing over the other of said floating pulleys with the first end of said second cable being connected to a second exercising unit or to said frame and the second end being connected to a third cable midway between its ends, said third cable being connected at each end thereof through mid-level pulley arrangements to another exercise unit, each mid-level pulley arrangement comprising a pulley means, and a pair of elongated juxtapositioned parallelly arranged rollers for each receiving therebetween a portion of a different end of said third cable and providing for continuously varying compound angle travel of said cable means during exercises, said rollers having a lengthwise extent that exceeds the depth of the rollers, whereby said redirected portion of each end of said third cable may be randomly moved along the surfaces of said rollers for providing variable angular travel of the ends of said third cable.

6. The exercise apparatus set forth in claim 5 wherein:

said cable and pulley system comprises three separate cables each connected to said single set of weights such that each of said three cables may be operated independently of the other cables in an unrestricted manner.

* * * * *

UNITED STATES PATENT AND TRADEMARK OFFICE

CERTIFICATE OF CORRECTION

PATENT NO. : 5,211,614

DATED : May 18, 1993

INVENTOR(S) : Richard W. Henes

It is certified that error appears in the above-identified patent and that said Letters Patent is hereby corrected as shown below:

Column 7, line 4, delete "removable" and substitute --movable--.

Signed and Sealed this

Fourteenth Day of December, 1993

Bruce Lehman

*Attest:*

BRUCE LEHMAN

*Attesting Officer*

*Commissioner of Patents and Trademarks*